US008740403B2

(12) United States Patent
Souvay

(10) Patent No.: US 8,740,403 B2
(45) Date of Patent: Jun. 3, 2014

(54) LINEAR LIGHT EMITTING DIODE (LED) LIGHTING FIXTURE

(75) Inventor: Francois-Xavier Souvay, Montreal (CA)

(73) Assignee: Lumenpulse Lighting, Inc. (CA)

( * ) Notice: Subject to any disclaimer, the term of this patent is extended or adjusted under 35 U.S.C. 154(b) by 0 days.

(21) Appl. No.: 13/579,701

(22) PCT Filed: Feb. 22, 2011

(86) PCT No.: PCT/IB2011/000358

§ 371 (c)(1), (2), (4) Date: Aug. 17, 2012

(87) PCT Pub. No.: WO2011/101736

PCT Pub. Date: Aug. 25, 2011

(65) Prior Publication Data

US 2012/0314407 A1 Dec. 13, 2012

Related U.S. Application Data

(60) Provisional application No. 61/306,655, filed on Feb. 22, 2010, provisional application No. 61/309,049, filed on Mar. 1, 2010, provisional application No. 61/362,862, filed on Jul. 9, 2010.

(51) Int. Cl.
*F21L 4/00* (2006.01)

(52) U.S. Cl.
CPC ..... *F21L 4/00* (2013.01)
USPC ..... 362/191; 362/190

(58) Field of Classification Search
CPC ..... F21L 4/00
See application file for complete search history.

(56) References Cited

U.S. PATENT DOCUMENTS

| | | | | |
|---|---|---|---|---|
| 7,559,672 | B1 * | 7/2009 | Parkyn et al. | 362/244 |
| 2005/0205878 | A1 | 9/2005 | Kan | |
| 2007/0263383 | A1 | 11/2007 | Ansems et al. | |
| 2008/0137355 | A1 | 6/2008 | Offermann et al. | |
| 2009/0021936 | A1 * | 1/2009 | Stimac et al. | 362/249 |
| 2010/0157610 | A1 * | 6/2010 | Xiao et al. | 362/370 |
| 2012/0127702 | A1 * | 5/2012 | Lax et al. | 362/184 |
| 2012/0218757 | A1 * | 8/2012 | Gill | 362/235 |
| 2013/0050997 | A1 * | 2/2013 | Bretschneider et al. | 362/190 |

FOREIGN PATENT DOCUMENTS

WO 2006/033031 A2 3/2006

* cited by examiner

*Primary Examiner* — Mary Ellen Bowman
(74) *Attorney, Agent, or Firm* — Burns & Levinson LLP; Joseph M. Maraia

(57) ABSTRACT

A light emitting diode (LED) lighting fixture having an elongated casing, an array of LEDs mounted on a printed circuit board and a holographic film element providing a near lossless optical element for redistributing the light emission patterns from adjacent ones of the LEDs into an array light emission pattern wherein the emitted light in a region of the array light emission pattern is comprised of a sum of overlapping light emission patterns of a plurality of the LEDs. The casing is divided into a lighting element compartment containing the LED printed circuit board and holographic film element and a power supply compartment containing at least one power supply, each being thermally isolated from the other.

10 Claims, 9 Drawing Sheets

LINEAR LIGHT EMITTING DIODE (LED) LIGHTING FIXTURE

CROSS REFERENCE TO RELATED APPLICATIONS

This application is the National Phase application of PCT/IB2011/000358 filed Feb. 22, 2011, which claims benefit from U.S. Provisional Patent Application Ser. No. 61/362,862 filed Jul. 9, 2010 and claims benefit from U.S. Provisional Patent Application Ser. No. 61/309,049 filed Mar. 1, 2010 and claims benefit from U.S. Provisional Patent Application Ser. No. 61/306,655 filed Feb. 22, 2010.

FIELD OF THE INVENTION

The present invention relates to a light emitting diode (LED) lighting fixture and, more particularly, to a linear LED lighting fixture eliminating scalloping effects and overcoming the effects of Kelvin variations in LEDs.

BACKGROUND OF THE INVENTION

Current lighting technology includes a number of different types of light sources, such as incandescent bulbs and various versions thereof, such a halogen and xenon bulbs, and flourescent tubes and bulbs, including compart fluorescent lamps (CFLs). One of the more recent light sources is light emitting diodes (LEDs) which have been, for a number of years, used for a variety of purposes. In particular, LEDs have been developed and used for lighting purposes of all types including general area and spot lighting and special purpose lighting applications, such as architectural lighting.

Such LED lighting fixtures typically include an LED or an array of white and/or red, green and blue LEDs wherein, the type and number of LEDs depend upon the desired output light spectrum and illumination output power of the fixture. The array or LEDs will often be linear but may be circular or of any other desired orientation or shape chosen to provide the desired light emission pattern. The LEDs are typically mounted onto a printed circuit board, together with a power supply unit and, in some fixtures, control circuitry that controls the illumination and the power output levels of the individual LEDs are included. The circuit board provides mechanical support for and interconnections between the LEDs, the power supply unit and the control circuitry, typically by soldered or bonded connections, and the assembly of the LED array, the power supply and the control circuitry is mounted into a casing that includes an optical enclosure.

LED lighting fixtures, however, typically have a number of associated problems which tend to limit generally their use in lighting fixtures. For example, the range of variation in the output power levels and even the output spectrums of the LEDs of a given type are often significantly greater than the variations found, for example, in conventional light sources, such as incandescent bulbs. Due to the tolerances of the LEDs with regard to degree Kelvin temperature, the LEDs on a printed circuit board strip typically do not have precisely or exactly the same brightness and/or color over the entire length of the strip. This problem, which is a function of the Kelvin temperature tolerances of the individual LEDs and which is often referred to as the "Kelvin variation", increases with the power output level of the LEDs and is particularly noticeable with high-power LEDs, which are otherwise particularly advantageous for use in general lighting fixtures because of their significantly higher per unit illumination power output. As a result of the variations in light output power and spectrum, that is, brightness and light color, the light output from an LED fixture is often of noticeable lower quality than the light output of a more conventional fixture, such as a fixture using incandescent or fluorescent elements. While these problems may be addressed, for example, by pretesting, sorting and/or selecting the LEDs to obtain sets of LEDs having more uniform characteristics, such methods significantly increase the associated time and costs in fabricating LED lighting fixtures which, in turn, leads to increased production costs.

Further, a commonly occurring problem for LED lighting fixtures arise from the light emission patterns of the LEDs. That is, light is emitted from the LEDs in a "spot-light beam" pattern, that is, in a conical or beam-like pattern having a relatively narrow emission angle, resulting in a light emission pattern having a relatively narrow central zone with high light level surrounded by a circular zone wherein the light level tapers rapidly off to zero. By comparison, a more conventional light source, such as an incandescent or fluorescent light source, more generally approximates a point or a linear light source and thus provides a generally uniform level of light emission over a generally spherical or cylindrical pattern.

The overlapping or adjoining light emission patterns of adjacent individual LEDs of an array of LEDs in a LED fixture thereby typically result in a light emission pattern for the fixture having a "scalloping effect." A "scalloping effect" is most commonly described as, an overall light emission pattern comprising, at least in part, a repeating pattern of adjacent lighter and darker illumination regions wherein each region is circular or forms a part of a circle.

The LED lighting fixtures of the prior art have attempted to eliminate the scalloping effect by various techniques and methods, but such methods significantly increase the cost and complexity of the LED fixtures. In addition, while such methods of the prior art can, for example, widen the beam emitted by an LED element or array to a certain limited degree, such methods still cannot achieve a generally uniform wide area light emission pattern of a more conventional point or linear light source, such as an incandescent or a fluorescent element, and, such methods typically reduce the emitted light level of the LED element or array by absorbing at least a part of the light emitted from the LEDs.

A still further problem of LED light fixtures is that, as described above, such fixtures comprise a relatively large number of components, such as an array of LEDs, a power supply unit, control circuitry, a printed circuit board providing mechanical support for and interconnections between the LEDs, a power supply unit and control circuits, and a casing that includes an optical enclosure and/or beam shaping elements. The assembly of these components into a lighting fixture of a reasonable or acceptable size often proves to be somewhat difficult as dimensions and shape factors imposes a number of design restrictions, such as mounting the components to the printed circuit board and making circuit connections typically by soldered or bonded connections. Other restrictions imposes by size and the form factor constraints may include, for example, close and interlocking packing of the components that, in turn, require that the components be assembled or disassembled in a fixed order rather than being individually accessible.

Such component assembly restrictions, in turn, result in still further problems, such as local heat build-up with a consequential increase in the component failure rate due to the lack of adequate cooling. Such restrictions also significantly increase the difficulty, time and costs required to remove and replace failed component(s) due to the need to remove one or more components to access the failed component(s) and the need to unsolder and/or unbond connections in order to remove the failed component(s), and the reversal of the steps following replacement of the failed component(s).

The present invention provides a solution to these and other related problems associated with the prior art.

SUMMARY OF THE INVENTION

The present invention is directed to a light emitting diode (LED) lighting fixture having an elongated casing, an array of LEDs mounted on a printed circuit board mounted into the casing wherein each LED of the LED array has a light emission pattern having a generally narrow conical emitted light distribution or illumination pattern, and a holographic film element mounted into the casing. The holographic film element is a near lossless optical element for redistributing the light emission patterns, from adjacent ones of the LEDs, into an array light emission pattern wherein the emitted light, in a region of the array light emission pattern, comprises a sum of overlapping light emission patterns of a plurality of the LEDs.

In a further aspect of the LED lighting fixture, according to the present invention, the elongated casing includes two parallel casing walls which are connected to one another by a partition wall which divides the casing into a lighting element compartment and a power supply compartment, wherein the lighting element compartment and the power supply compartment are mutually thermally isolated from one another by the casing partition wall. The printed circuit board and the holographic film element are mounted within the lighting element compartment of the casing and at least one power supply is mounted on a power supply support which is mounted within the power supply compartment of the casing.

BRIEF DESCRIPTION OF THE DRAWINGS

The invention will now be described, by way of example, with reference to the accompanying drawings in which.

DETAILED DESCRIPTION OF THE INVENTION

Referring first to FIGS. 1A, 1B and 1C and 2A, 2B and 2C, the linear LED light fixture 10 of the present invention includes an elongated casing 12 comprising two spaced apart parallel casing walls 12A and 12B intereconnected with one another by a partition wall 12C that divides casing 12 into a first lighting element compartment 14A and a second power supply compartment 14B. As shown, the overall length or "height" of the casing walls 12A and 12B are typically greater than the overall length or "width" of the partition wall 12C and the height of the power supply compartment 14B will typically be greater than the height of the lighting element compartment 14A. In this regard, and as will be seen from the following description of the fixture 10, the use of the terms "height" and "width" is not intended to and should not be taken as referring to a particular vertical or horizontal orientation of the fixture 10, particularly as the fixture 10 may be oriented along any axis with respect to the vertical and/or the horizontal directions. In a like manner, the relative dimensions and proportions of the casing 12, the casing walls 12A and 12B, the partition wall 12C and the first lighting element compartment 14A and the second power supply compartment 14B will be determined by the dimensions of the components to be contained therein and may vary accordingly from implementation to implementation of any desired fixture 10.

According to the present invention, the lighting components 16 located or accommodated within lighting element compartment 14A, include a plurality of LEDs 16A arranged in an array 16B on a printed circuit board 16C that provides a mechanical support for LEDs 16A and for circuit interconnections between LEDs 16A and potentially, for example, the LED power supply or LED power supplies, which are described below in further detail. The LEDs 16A may be arranged in an LED array 16B in a number of configurations, such as a single line of adjacent LEDs 16A, as multiple parallel lines of LEDs 16A, as one or more staggered rows of adjacent LEDs 16A, as a linear arrangement of groups of LEDs 16A, as a circular groups of LEDs 16A, etc., depending upon the particular application, and a few exemplary LED circuits are diagrammatically illustrated in FIGS. 3A, 3B, 3C and 3D, for example. It will also be recognized that the dimensions of the LED array 16B, such as the array length, may vary substantially between one fixture 10 and another fixture 10, as may the dimensions of the LEDs 16A and the spacing between adjacent LEDs 16A and spacing between groups of LEDs 16A within the array 16B.

Figure 1A:
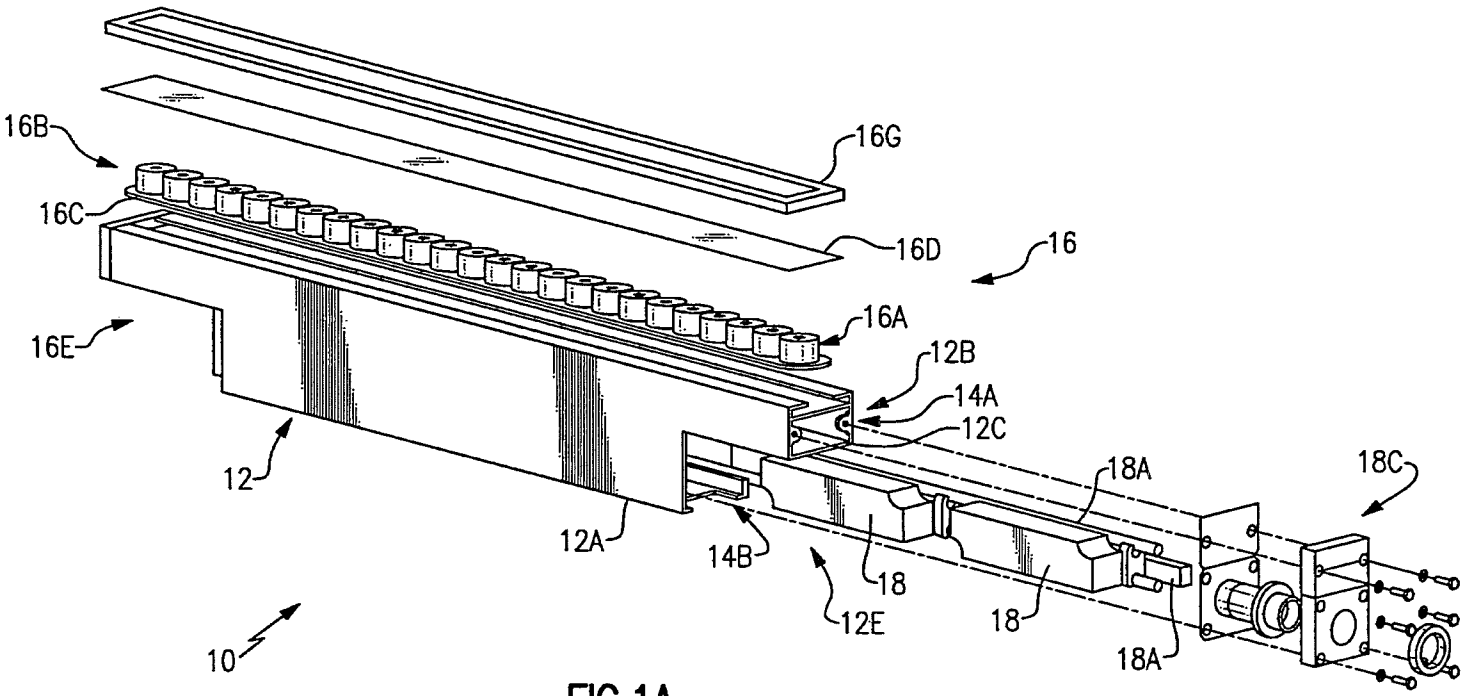
FIG. 1A is an exploded diagrammatic isometric representation of a linear LED light fixture.
Figure 1B:
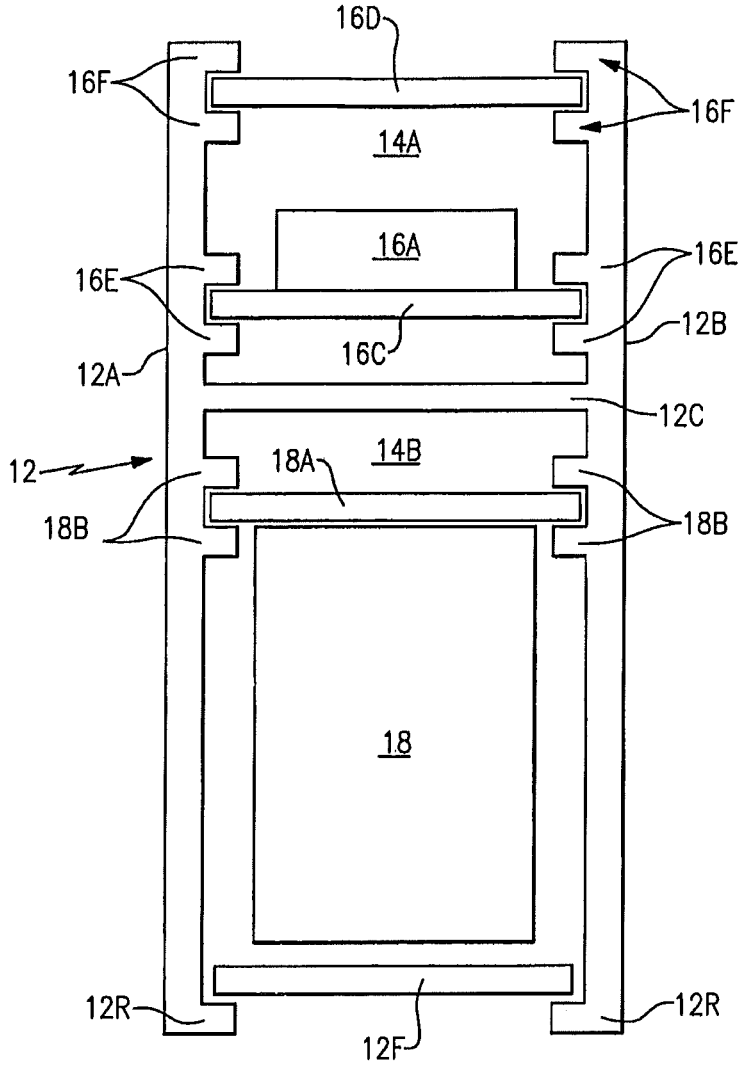
FIG. 1B is a diagrammatic cross section view of a first embodiment of a linear LED light fixture.

As shown in FIG. 1B, and for example, the printed circuit board 16C and the LEDs 16A mounted thereon in the LED array 16A are supported and retained in the lighting element compartment 14A by between two pairs of adjacent printed circuit board rails 16E respectively formed in or on or mounted to the interior sides of the casing walls 12A and 12B. The LED array 16B is slid longitudinally into engagement with and between each pair of the printed circuit board rails 16E from a first end or from the opposite end 12E of the casing 12.

The lighting components 16, located in lighting element compartment 14A, further include a holographic film element 16D which is also supported and retained, within the lighting element compartment 14A, by two pairs of adjacent film rails 16F, which are also respectively formed in or on or mounted to the interior sides of the casing walls 12A and 12B. The holographic film element 16D is slid longitudinally into engagement with and between the two pairs of the holographic film rails 16F from the first end or the opposite end 12E of the casing 12. It will be appreciated that the arrangement of printed circuit board rails 16E and the film rails 16F, for respectively mounting printed circuit board 16C and the holographic film element 16D shown in FIG. 1B, are exemplary and that other functionally equivalent arrangements and structures will be readily apparent to those of ordinary skill in the relevant art.

Figure 1C:
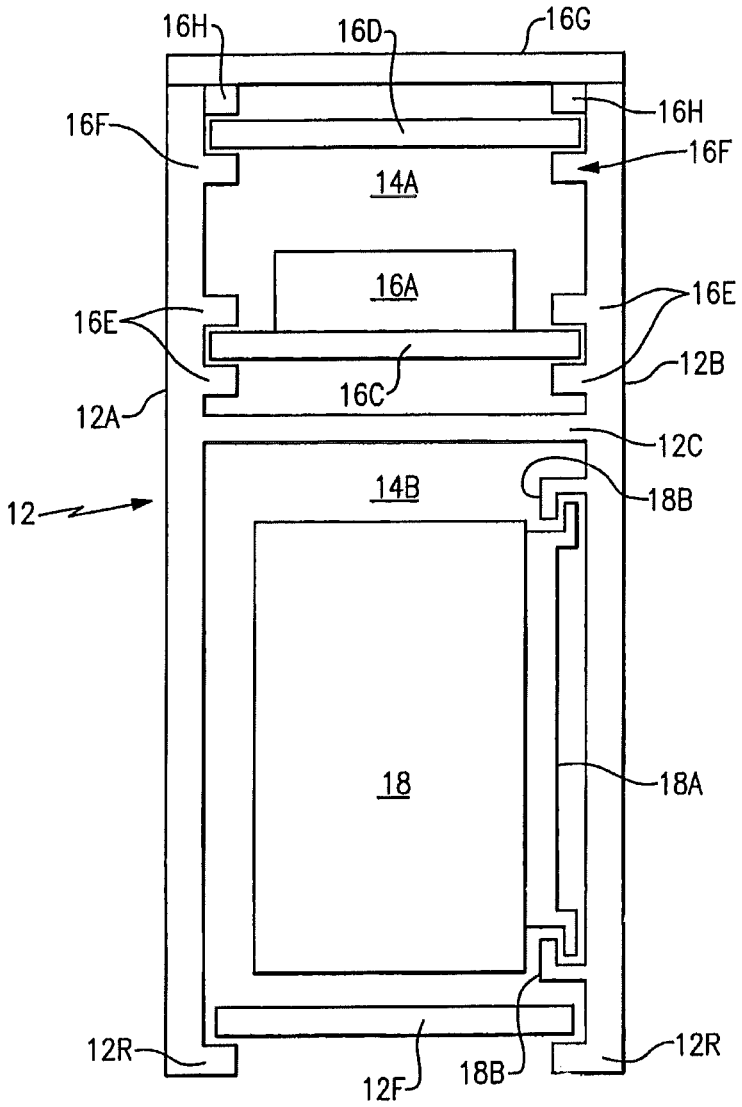
FIG. 1C is a diagrammatic cross section view of a second embodiment of a linear LED light fixture.
Figure 2A:
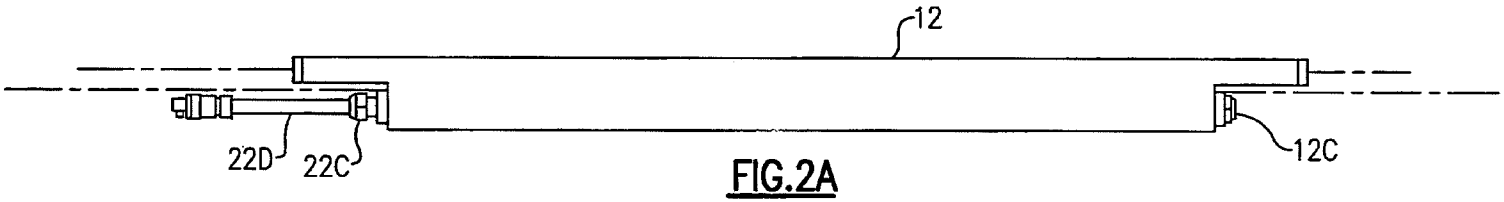
FIG. 2A is a diagrammatic side elevational view a linear LED light fixture.
Figure 2B:
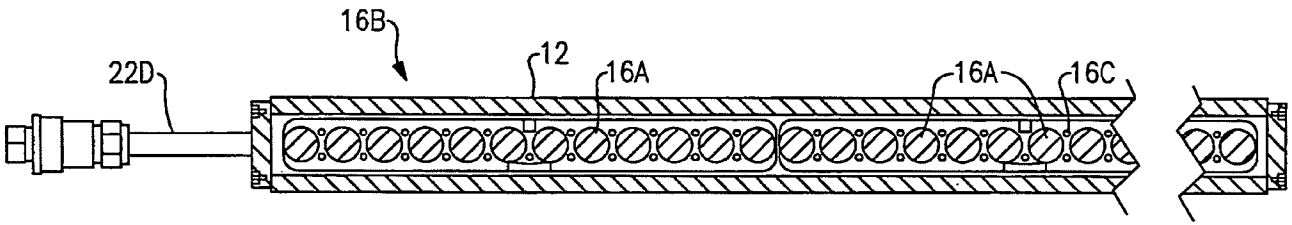
FIG. 2B is a diagrammatic top plan view the linear LED light fixture of FIG. 2A.
Figure 2C:
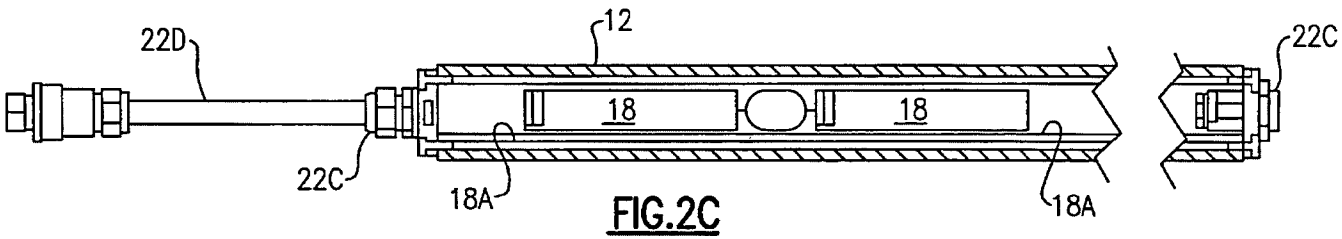
FIG. 2C is a diagrammatic bottom plan view a linear LED light fixture of FIG. 2A.
Figure 3A:
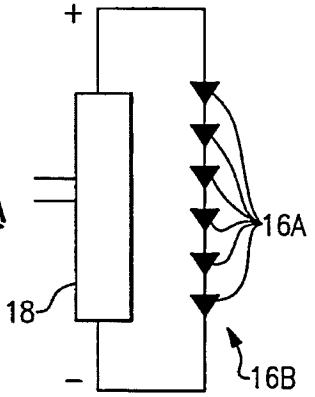
FIGS. 3A, 3B, 3C and 3D are diagrammatic embodiments of exemplary LED lighting circuits according to the present invention.
Figure 3B:
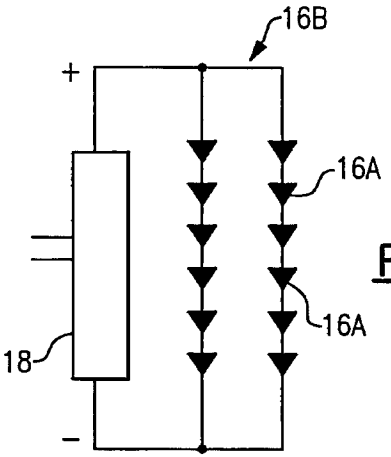
Figure 3C:
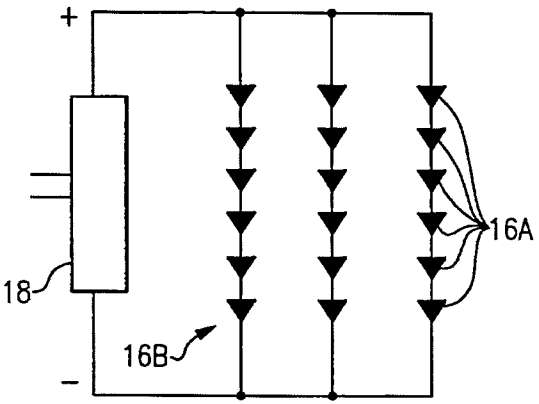
Figure 3D:
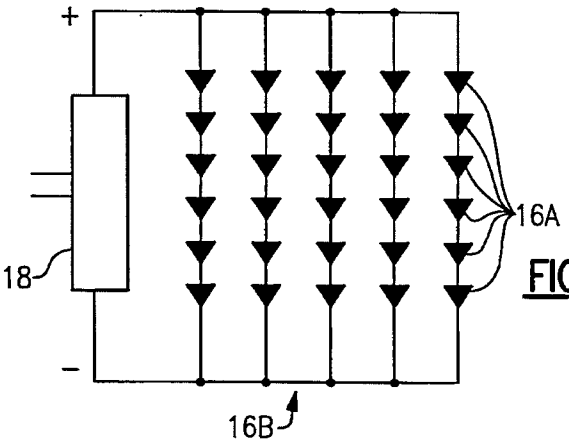

Turning now to FIG. 1C, an alternative arrangement for the lighting fixture is shown. According to this embodiment, the holographic film element 16D is supported on one side by a pair of spaced apart rails 16F, and is supported on the opposing side by a pair of spaced apart spacers 16H. The lighting element compartment 14A, of the lighting fixture 10, is then sealingly close to the elements by a covering element 16G. The pair of spacers 16H may ideally be attached to the covering element 16G so that when the covering element 16G is removed, the holographic film element 16D may easily removed, replaced, repaired, etc., and provide access to the LEDs 16A without having to slide the LED array 16B out of the casing 12A. Conversely, when the covering element 16G is attached, the pair of spacers 16H apply a frictional force to and against the holographic film element 16D thereby retaining and securing holographic film element 16D in its desired location between the pair of rails 16F and the pair of spacers 16H.

The covering element 16G generally functions to close and seal the fixture 10 from the elements while still allowing the light, emitted from the LED array 16B, to readily pass through, substantially unaffected, and exit the fixture 10 through the transparent covering element 16G. At least one portion of the covering element 16G will be made from at least a partially transparent material, such as glass and/or plastic, and that partially transparent material may have a desired magnification value of less than 1 or greater than 1, or no magnification value, i.e., a magnification value of 1.

Figure 4A:
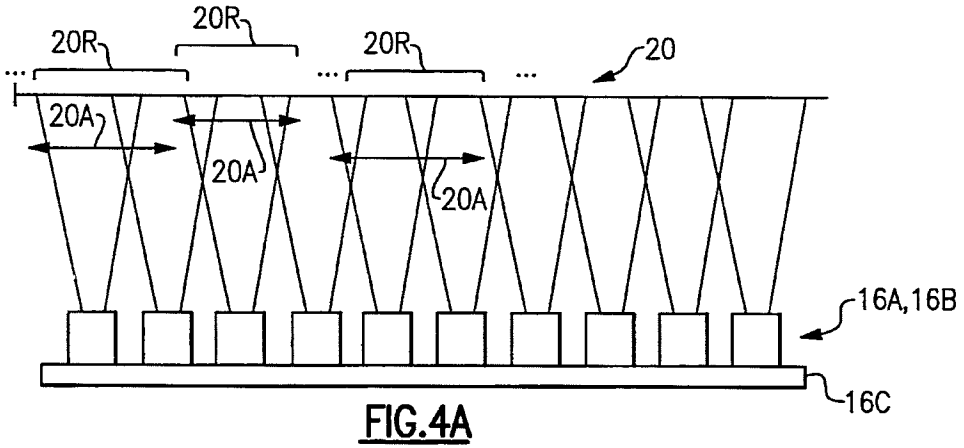
FIGS. 4A and 4B are diagrammatic embodiments of exemplary illustrations of the light emission patterns of a LED array and of an LED array with a holographic optical film element.

Now considering the holographic film element 16D in further detail, and referring to FIG. 4A, the scalloping effect briefly described above is diagrammatically shown. The LEDs of a conventional LED array, diagrammatically shown in FIG. 4A, emits light at a relatively narrow conical emission angle thereby resulting in a relatively narrow circular light emission pattern having high intensity light level central zones surrounded by relatively narrow lower intensity light level zones. Thus, the light emission pattern 18 of the conventional LED arrays typically demonstrates a "scalloping effect", that is, a repeating pattern of adjacent circular or partially circular regions having higher intensity, i.e., lighter regions, and lower intensity, i.e., darker regions. As described, the LED lighting fixtures of the prior art have attempted to eliminate such "scalloping effect" by various methods and techniques. While such methods and techniques can, for example, widen the beam emitted by an LED element or array to a limited extent, such elements still do not achieve the wide area light emission patterns of more conventional point or linear light sources, such as incandescent or fluorescent elements. In addition, such methods typically reduce the emitted light level of the LED element or array by absorbing at least a part of the light emitted from the LEDs.

Figure 4B:
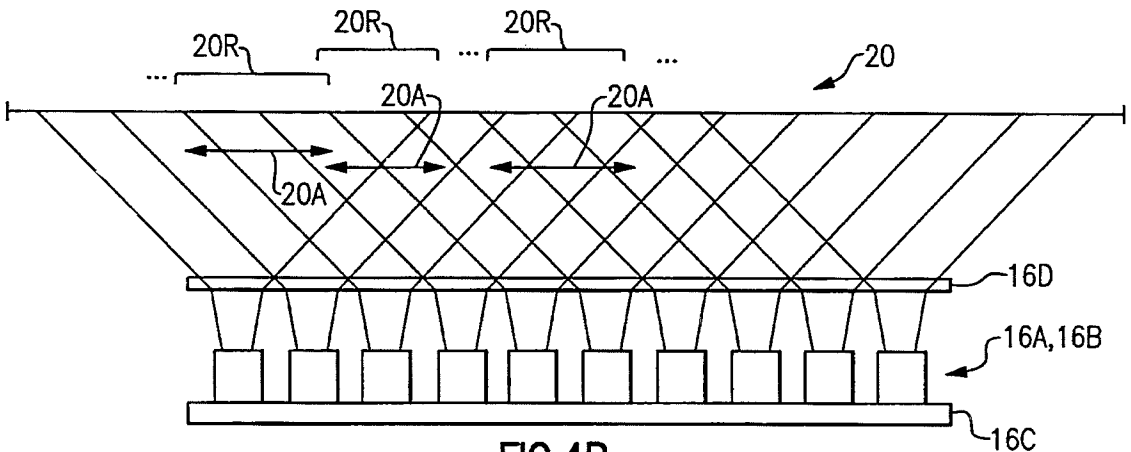

The present invention, however, as shown in exemplary illustration in FIG. 4B, thus includes a holographic film element 16D which functions as a near lossless optical element that redistributes the light patterns, emitted from adjacent individual LEDs 16A or groups of LEDs 16A of the LED array 16B, into a desired light emission pattern 20. The emitted light falling within any region 20R of the fixture light emission pattern 20 comprises the sum of overlapping light emission patterns of a plurality of LEDs 16A, including adjacent LEDs 16A and typically including non-adjacent LEDs 16A. Therefore, the light emission pattern 20A, of each region 20R of the light emission pattern 20 of the fixture 10 having the holographic film element 16D, essentially comprises averaged emissions of a plurality of LEDs 16A. As a result, the emission pattern 20 according to the present invention is significantly more uniform over a relatively wide area, by significantly reducing or effectively eliminating the scalloping effect normally present in conventional LED lighting fixtures, and approximates the light emission pattern of more conventional light sources, such as incandescent and fluorescent elements.

According to a further aspect of the present invention, the holographic film 16D also provides a solution to the problems resulting from Kelvin variations between the LEDs 16A of the LED array 16B. That is, and as described above, the emitted light falling in any region 20R of the fixture light emission pattern 20, comprises an overlapping, averaged sum of the light emission patterns of a plurality of LEDs 16A. As a consequence of this, the Kelvin variations between adjacent LEDs 16A or groups of LEDs 16A contributing to the light emission pattern 20A, in any region 20R of the fixture light emission pattern 20, are averaged over that region 20R. Such averaging significantly reduces the apparent Kelvin variations between the LEDs 16A contributing to the light emission falling within any region 20R. The light emission patterns 20A of adjacent and overlapping regions 20R of the light fixture emission pattern 20 likewise comprise contributions from adjacent LEDs 16A and groups of LEDs 16A so that the Kelvin variations, between adjacent or overlapping regions 20R of the fixture light emission pattern 20, are likewise averaged across each corresponding group of LEDs 16A, thereby significantly reducing or effectively eliminating the effects of the individual LED 16A Kelvin variations of the LEDs 16A of the LED array 16B. As a result, the present invention thereby provides a more uniform illumination pattern for the fixture 10.

It will be appreciated that the specific holographic pattern and the dimensions of holographic film element 16D are dependent, at least in part, upon the dimensions of the emission light patterns of the LEDs 16A, the locations and spacing of the adjacent LEDs 16A or groups of LEDs 16A in the LED array 16B, and the relative spatial geometry between the LED array 16B, the LEDs 16A of LED array 16B, the holographic film element 16D and the covering element 16G.

The methods for designing holographic film elements 16D, and the holographic patterns thereof for different LED arrays 16B and LEDs 16A, to achieve the desired results, will be well understood by those of ordinary skill in the relevant art. As such, a further detailed description concerning same is not provided herein.

Next considering further aspects of the present invention, it has been described above that the printed circuit board 16C and the LEDs 16A, of the LED array 16B, are mounted within the lighting element compartment 14A of the casing 12. In a like manner, one or more power supplies 18 are mounted on a slidable elongated power supply support 18A that is, in turn, supported and retained within the power supply compartment 14B by a pair of spaced apart power rails 18B formed in or on, or mounted to an interior surface of one of both of the casing walls 12A and/or 12B. As a result, the power supply support 18A can be readily slid longitudinally into engagement with power supply rails 18B from either the first end or the opposite end 12E of the casing 12, to facilitate either removal or insertion thereof. It is noted that FIG. 1B discloses an embodiment where the elongated power supply support 18A engages a set of rails which are supported by only one of the casing walls 12A or 12B, e.g., the casing wall 12B, while FIG. 1C discloses an embodiment where the elongated power supply support 18A engages with and is located between two sets of spaced apart rails, with one set of rails 18B being supported by the first casing wall 12A and the other set of rails 18B being supported by the second casing wall 12B.

As illustrated in FIGS. 1B and 1C, a bottom portion or lower area of the power supply compartment 14B is typically closed by an elongated power supply cover 12P, that slidably engages with corresponding cover rails 12R that, like power supply rails 18B, may be generally similar in structure to the printed circuit board rails 16E and/or the holographic film rails 16F. Similar to the covering element 16G, the elongated power supply cover 12P provides a barrier which closes and seals a bottom portion of the power supply compartment 14B and protects that compartment from the elements.

It is to be appreciated that the number of power supplies 18, mounted in power supply compartment 14B, is determined by the number and power requirements of the LEDs 16A of the LED array 16B to be powered by the fixture. The power outputs of the power supplies 18 (not shown in detail) are connected to the printed circuit board 16C of the LED array 16B in a conventional manner by, for example, conventional leads, contacts and/or studs typically passing through the casing partition wall 12C (not shown in detail). As diagrammatically illustrated in FIGS. 1A, 2A, 2B and 2C, for example, the power inputs 22 are connected to the power supplies 18 through conventional connectors 22C and cables 22D, mounted on the end plates 18C that are, in turn, mounted on the first end or the opposite end 12E of the casing 12, which retain the printed circuit board 16C within the lighting element compartment 14A and the power supply support 18A within power supply compartment 14B. As can be seen from FIGS. 1A, 2A, 2B and 2C for example, the connectors 22C and the cables 22D may be used to connect the power supplies 18 to a conventional power source, such as a 117 volt AC line or to fixture power and control cabling, and may be used to sequentially connect the power supplies 18 of two or more fixtures 18 with one another into a single circuit that is ultimately connected to the 117 volt AC line or to the fixture power and the control cabling to facilitate control thereof.

According to the present invention, the lighting components 16 and the power supplies 18 are mounted in thermally separated compartments of the fixture 10. That is, the lighting components 16 are mounted and accommodated within the lighting element compartment 14A while the power supplies 18 are mounted and accommodated within the power supply compartment 14B. Such separate mounting of the lighting components 16 from the power supplies 18 thereby thermally isolates the lighting components 16 and the power supplies 18 from one another. As a result of this, the heat load imposed on the lighting components 16 and/or the power supplies 18, due to heat generated and dissipated by the other of the power supplies 18 and/or the lighting components 16, is thereby significantly reduced which, in turn, significantly reduces the heat load effects on the lighting components 16 and/or the power supplies 18. Due to such thermal isolation of these components, this in turn reduces the failure rate of the lighting components 16 as well as the failure rate of the power supplies 18 and thereby improves the overall reliability of the lighting fixture according to the present invention.

Figure 5B:
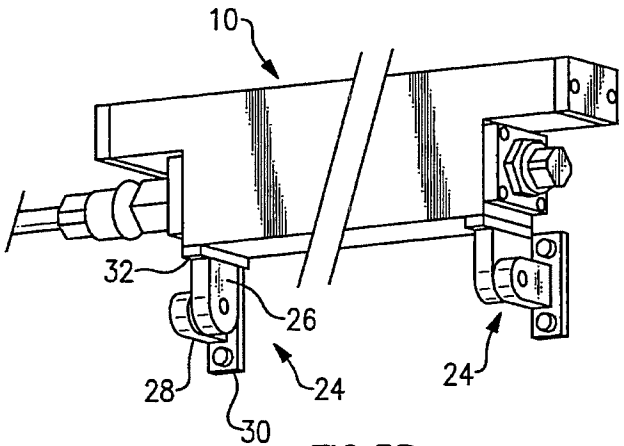
FIGS. 5A and 5B are diagrammatic isometric representations of a linear LED light fixture with pivoting mounting brackets.
Figure 5A:
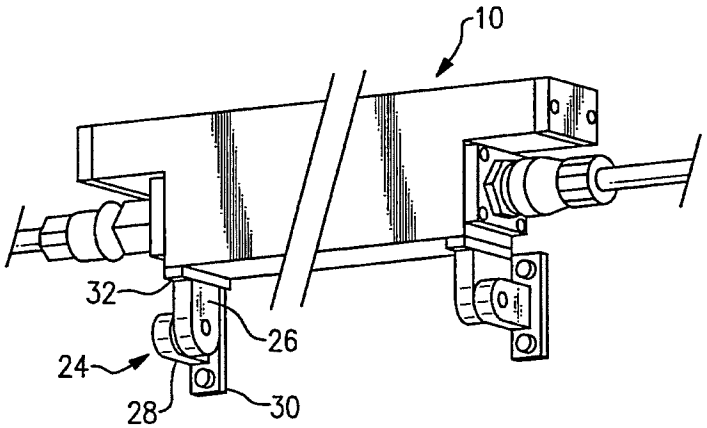
Figure 7:
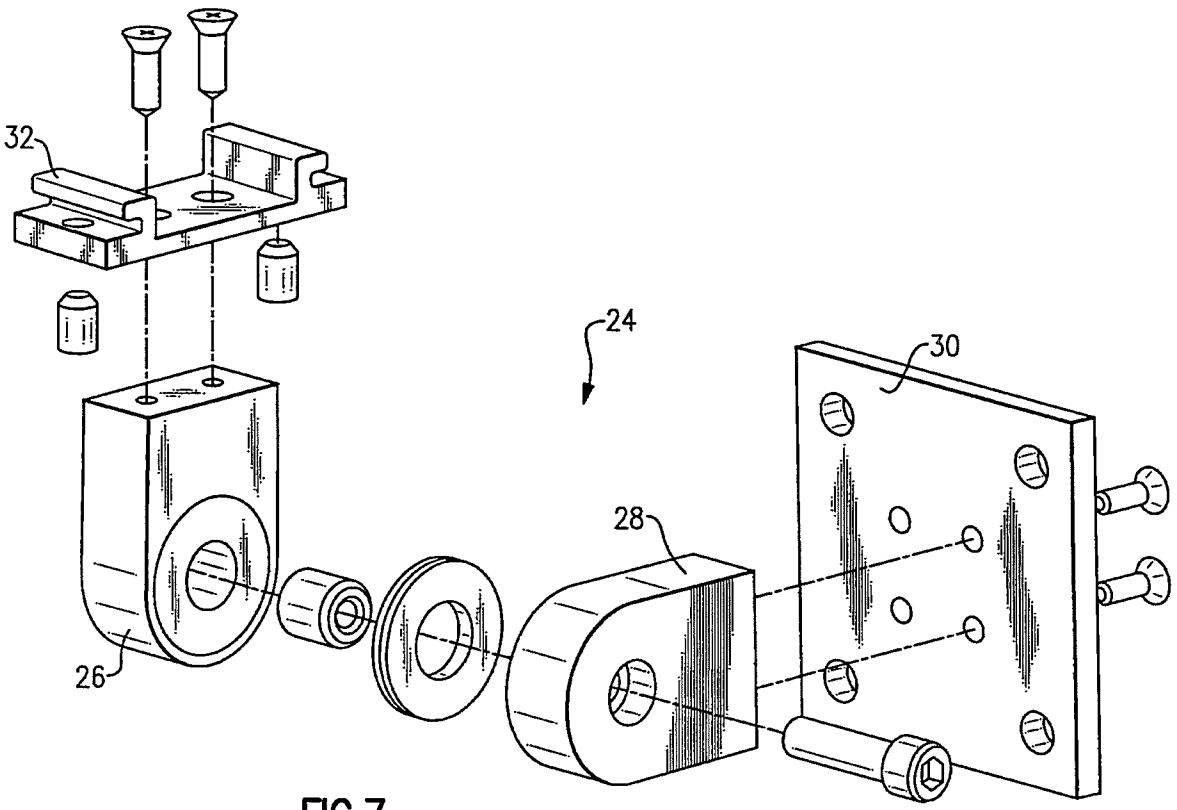
FIG. 7 is an exploded diagrammatic isometric representation of a mounting bracket for the linear LED light fixture.

With reference now to FIGS. 5A and 5B, a pair of opposed swivel brackets 24 are diagrammatically shown for mounting the fixture 10 to a desired surface. FIGS. 5A and 5B are diagrammatic isometric illustrations of the fixtures 10 in which the pair of swivel brackets 24 allow a range of movement of the light fixture 10, e.g., a range of movement of approximately 300° about a longitudinal a longitudinal axis of the fixture 10. It is to be appreciated that the mounting of the fixture 10, via the swivel brackets 24, is especially advantageous for grazing applications, e.g., façade illumination, which permits desired alignment of the illumination emitted from the fixture 10 as required or necessary to achieve the particular lighting effect. As shown in FIGS. 5A, 5B, and 7, the swivel bracket 24 connects the fixture 10 to a desired supporting element, such as a wall (not shown), via a plate 30, a first hinge part 28, a second hinge part 26, and an exterior mount 32. Once the fixture 10 is positioned in a desired orientation with respect to the swivel bracket 24, the various components are sufficiently tightened to retain the fixture 10 in that adjusted orientation. As a result of such arrangement, the fixture 10 can be readily mounted to any desired surface, such as a ceiling, an exterior wall, an interior wall, a floor, a ledge, a façade, etc., and then positioned in any desired orientation so as to provide the desired illumination effect for the particular lighting application.

Figure 6:
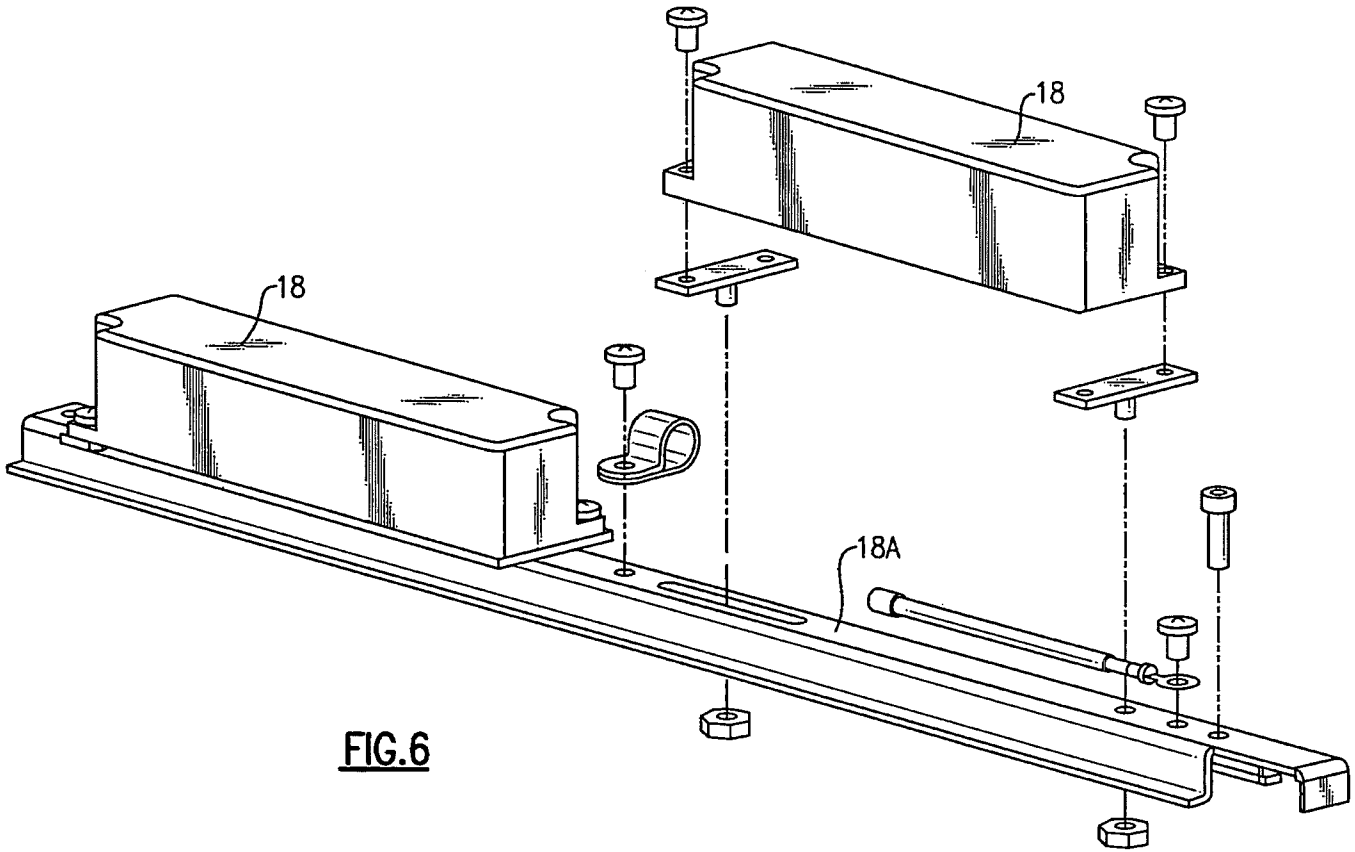
FIG. 6 is an exploded diagrammatic isometric representation of a power supply assembly of a linear LED light fixture.

As can be seen in FIGS. 1A and 6, the present invention facilitates ease of repair and/or replacement of one or more of the power supplies 18 and/or any other component(s) which are mounted or accommodated within the power supply compartment 14B or possibly the lighting element compartment 14A. That is, when any servicing, repair and/or replacement of any component(s) contained within the power supply compartment 14B or possibly the lighting element compartment 14A is desired or necessary, the service personnel will first remove the bearing 24 and then the end cover 18C so as to provide access to one end of the power supply compartment 14B or possibly the lighting element compartment 14A. The service personnel can then easily grasp the adjacent end of the elongated power supply support 18A and either partially or completely withdraw or remove the same, from the power supply compartment 14B, by sliding the elongated power supply support 18A relative to the two sets of spaced apart rails 18B, e.g., sufficiently sliding the elongated power supply support 18A until the elongated power supply support 18A is adequately withdrawn or retracted from the power supply compartment 14B so as to provide access to the component(s) to be serviced, repaired or replaced.

Once the component is adequately serviced, repaired and/or replaced, the service personnel then reverses the process by sliding the elongated power supply support 18A, relative to the two sets of spaced apart rails 18B, back into the power supply compartment 14B until the elongated power supply support 18A is completely accommodated within the power supply compartment 14B. Next, the service personnel will then first reattach the end cover 18C and the bearing 24 to the fixture 10 and then readjust the fixture 10 so it is again located in its previous orientation, to provide the desired illumination effect.

Since certain changes may be made in the above described improved LED lighting fixture, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A light emitting diode (LED) light fixture comprising:

an elongated unitary casing, the elongated casing comprises parallel spaced apart first and second casing walls which are interconnected with one another by a partition wall which divides the casing into a lighting element compartment and a power supply compartment, the lighting element compartment and the power supply compartment are mutually thermally isolated from one another by the partition wall;

an array of LEDs mounted on a printed circuit board which is mounted within the lighting element compartment of the casing, wherein each LED of the LED array has a light emission pattern which includes a generally narrow conical emitted light distribution;

a holographic film element being mounted within the lighting element compartment of the casing, the holographic film element comprises a holographic pattern for redistributing the light emission patterns from adjacent ones of the LEDs into an array light emission pattern, and the emitted light in a region of the array light emission pattern comprises a sum of overlapping light emission patterns of a plurality of the LEDs; and at least one power supply is mounted to a power supply support which is mounted within the power supply compartment of the casing, the power supply compartment is enclosed and sealed to protect the power supply from the elements.

2. The light emitting diode (LED) light fixture according to claim 1, wherein the light emitting diode (LED) light fixture further comprises a covering element with at least one transparent section, and the at least one transparent section is arranged so that light emitted from the LED array which passes through the holographic film exits the light emitting diode (LED) light fixture by passing through the at least one transparent section.

3. The light emitting diode (LED) light fixture according to claim 2, wherein at least a portion of the at least one transparent section has a magnification equal to one.

4. The light emitting diode (LED) light fixture according to claim 2, wherein at least a portion of the at least one transparent section has a magnification value greater than one.

5. The light emitting diode (LED) light fixture according to claim 2, wherein at least a portion of the at least one transparent section has a magnification value less than one.

6. The light emitting diode (LED) light fixture according to claim 1, wherein the power supply support is slidably mounted within an interior of the power supply compartment via a pair of rails so as to facilitate sliding removal thereof via an end of the light emitting diode (LED) light fixture.

7. The light emitting diode (LED) light fixture according to claim 6, wherein the power supply support extends generally normal to and is located between the first and the second casing walls.

8. The light emitting diode (LED) light fixture according to claim 6, wherein the power supply support is located between the first and the second casing walls, extends generally parallel to the first and the second casing walls but is supported by only one of the first and the second casing walls.

9. The light emitting diode (LED) light fixture according to claim 1, wherein the power supply support supports a plurality of sequentially arranged power supplies within the power supply compartment of the casing.

10. The light emitting diode (LED) light fixture according to claim 1, wherein a single power supply supplies electrical power a plurality of LED arrays coupled in parallel with one another.

* * * * *